US006964350B1

(12) United States Patent
Padilla

(10) Patent No.: US 6,964,350 B1
(45) Date of Patent: Nov. 15, 2005

(54) HANDKERCHIEF DISPENSING APPARATUS

(76) Inventor: Manuel Padilla, 131-11 Kew Garden Rd. #6B, Rechmond Hill, NY (US) 11418

( * ) Notice: Subject to any disclaimer, the term of this patent is extended or adjusted under 35 U.S.C. 154(b) by 3 days.

(21) Appl. No.: 10/320,568

(22) Filed: Dec. 13, 2002

(51) Int. Cl.[7] ..... B65G 59/00
(52) U.S. Cl. ..... 221/199; 221/87; 221/124; 206/39.4
(58) Field of Search ..... 221/87, 124, 199

(56) References Cited

U.S. PATENT DOCUMENTS 1,734,644 A * 11/1929 Ostrander et al. ..... 221/232
3,009,155 A * 11/1961 Leniz ..... 81/44
4,158,230 A 6/1979 Washizuka et al.
4,206,838 A * 6/1980 Bradley ..... 194/214
4,555,020 A * 11/1985 Campello et al. ..... 206/235
4,798,310 A * 1/1989 Kasai et al. ..... 221/87
4,865,223 A * 9/1989 Huang ..... 221/259
4,905,869 A * 3/1990 Grigsby et al. ..... 221/92
4,991,738 A * 2/1991 Peterson ..... 221/1
5,093,760 A 3/1992 Bedol
5,127,545 A * 7/1992 French ..... 221/102
5,131,563 A * 7/1992 Yablans ..... 221/92
5,215,212 A * 6/1993 Stephan ..... 206/387.12
5,244,115 A * 9/1993 Huck ..... 221/231
5,526,955 A * 6/1996 Windorski et al. ..... 221/34
5,630,526 A * 5/1997 Moody ..... 221/45
6,068,157 A * 5/2000 Kamiya ..... 221/36
6,155,456 A * 12/2000 Archer ..... 221/231
6,279,170 B1 8/2001 Chu

* cited by examiner

*Primary Examiner*—Eileen D. Lillis
*Assistant Examiner*—Rashmi Sharma

(57) ABSTRACT

A handkerchief dispensing apparatus for containing and dispensing handkerchiefs for a user. The handkerchief dispensing apparatus includes a housing comprising a base wall and a perimeter wall. The perimeter wall and the base wall define a receiving space of the housing for receiving the handkerchiefs. The perimeter wall comprises a dispensing slot extending through the perimeter wall of the housing for permitting a portion of each of the handkerchiefs to extend through the perimeter wall when the handkerchiefs are positioned in the receiving space of the housing. A lid member is hingably coupled to the housing. The lid member selectively closes the open end of the receiving space when the lid member is positioned over the housing. A dispensing assembly is coupled to the housing. The dispensing assembly is designed for feeding one of the handkerchiefs through the dispensing slot when the dispensing assembly is actuated by the user.

14 Claims, 3 Drawing Sheets

HANDKERCHIEF DISPENSING APPARATUS

BACKGROUND OF THE INVENTION

1. Field of the Invention

The present invention relates to calculators and more particularly pertains to a new handkerchief dispensing apparatus for containing and dispensing handkerchiefs for a user.

2. Description of the Prior Art

The use of calculators is known in the prior art. U.S. Pat. No. 4,158,230 describes a system for executing and displaying math functions. Another type of calculators is U.S. Pat. No. 5,093,760 having a calculator assembly having a resilient clip for allowing the calculator to be clipped onto items. U.S. Pat. No. 6,279,170 has a label comprising a display for displaying information that is applied to a garment.

While these devices fulfill their respective, particular objectives and requirements, the need remains for a device that has certain improved features for dispensing handkerchiefs.

SUMMARY OF THE INVENTION

The present invention meets the needs presented above by providing a housing for containing handkerchiefs and a dispensing assembly for dispensing the handkerchiefs.

Still yet another object of the present invention is to provide a new handkerchief dispensing apparatus that provides a calculating assembly to allow the user to perform math calculations.

To this end, the present invention generally comprises a housing comprising a base wall and a perimeter wall. The perimeter wall and the base wall define a receiving space of the housing. The receiving space of the housing comprises an open end whereby the open end is designed for permitting the handkerchiefs to inserted into the receiving space of the housing. The perimeter wall comprises a dispensing slot extending through the perimeter wall of the housing. The dispensing slot is designed for permitting a portion of each of the handkerchiefs to extend through the perimeter wall when the handkerchiefs are positioned in the receiving space of the housing. A lid member is hingably coupled to the housing. The lid member selectively closes the open end of the receiving space when the lid member is positioned over the housing. A dispensing assembly is coupled to the housing. The dispensing assembly is designed for engaging the handkerchiefs whereby the dispensing assembly feeds one of the handkerchiefs through the dispensing slot when the dispensing assembly is actuated by the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
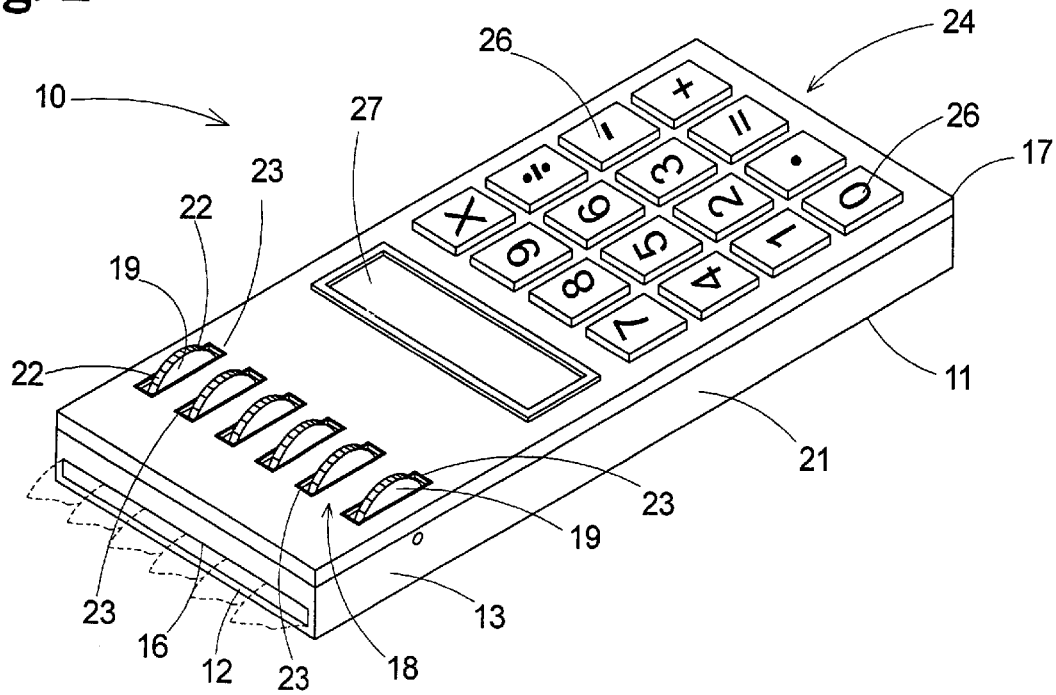
FIG. 1 is a perspective view of a new handkerchief dispensing apparatus according to the present invention.
Figure 2:
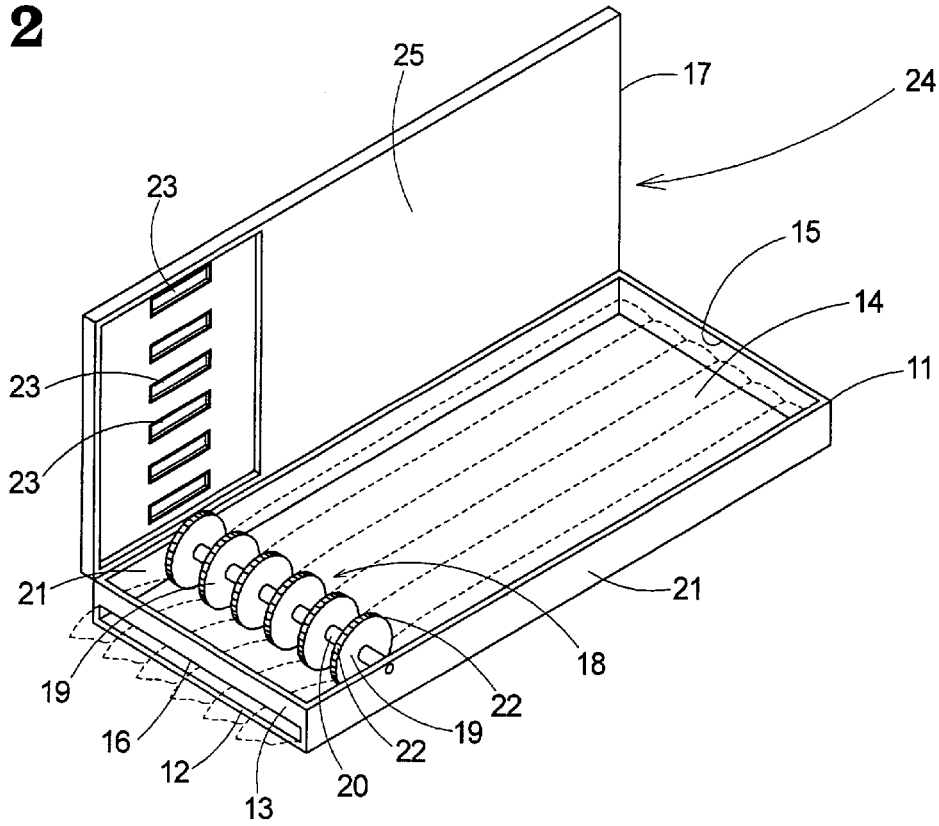
FIG. 2 is a perspective view of the present invention shown with the lid member pivoted away from the housing.
Figure 3:
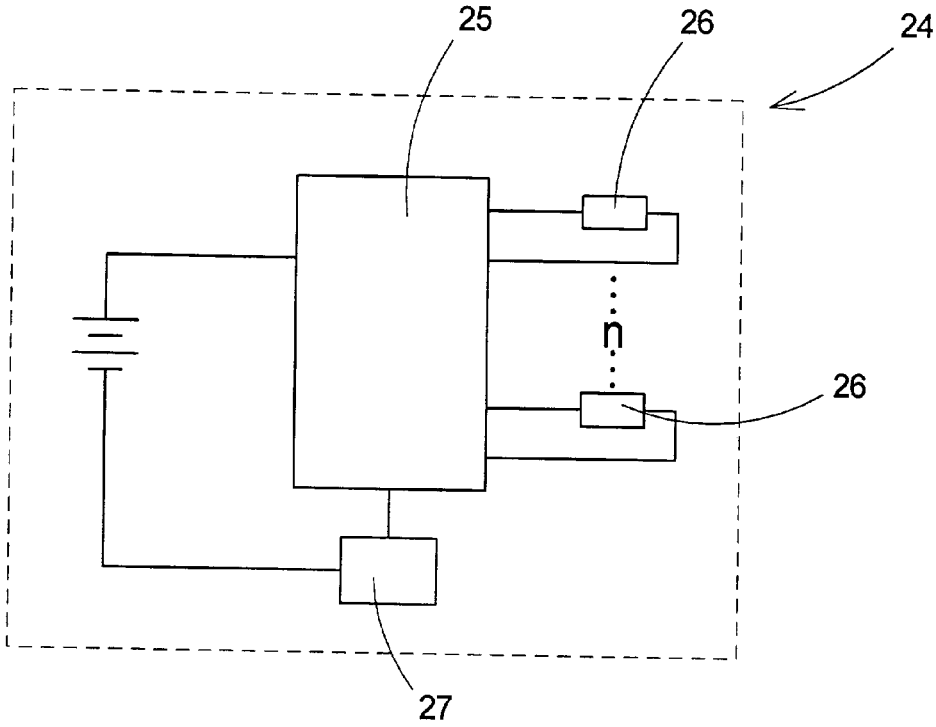
FIG. 3 is a schematic view of the calculator assembly of the present invention.

With reference now to the drawings, and in particular to FIGS. 1 through 3 thereof, a new handkerchief dispensing apparatus embodying the principles and concepts of the present invention and generally designated by the reference numeral 10 will be described.

As best illustrated in FIGS. 1 through 3, the handkerchief dispensing apparatus 10 generally comprises a housing 11 comprising a base wall 12 and a perimeter wall 13. The perimeter wall 13 and the base wall 12 define a receiving space 14 of the housing 11. The receiving space 14 of the housing 11 comprises an open end 15 whereby the open end 15 is designed for permitting the handkerchiefs to be inserted into the receiving space 14 of the housing 11. The base wall 12 comprises a dispensing slot 16 extending through the base wall 12 of the housing 11. The dispensing slot 16 is designed for permitting a portion of each of the handkerchiefs to extend through the base wall 12 when the handkerchiefs are positioned in the receiving space 14 of the housing 11.

A lid member 17 is hingably coupled to the housing 11. The lid member 17 selectively closes the open end 15 of the receiving space 14 when the lid member 17 is positioned over the housing 11.

A dispensing assembly 18 is coupled to the housing 11. The dispensing assembly 18 is designed for engaging the handkerchiefs whereby the dispensing assembly 18 feeds one of the handkerchiefs through the dispensing slot 16 when the dispensing assembly 18 is actuated by the user.

The dispensing assembly 18 comprises a plurality of rollers 19. Each of the rollers 19 is rotatably coupled to the housing 11. Each of the rollers 19 is designed for engaging one of the handkerchiefs whereby each of the rollers 19 is designed to facilitate dispensing of the associated one of the handkerchiefs when one of the rollers 19 is rotated with respect to the housing 11 by the user.

The dispensing assembly 18 comprises an axle member 20. The axle member 20 extends between a pair of side walls 21 of the perimeter wall 13. Each of the rollers 19 is rotatably coupled to the axle member 20 whereby each of the rollers 19 rotates around the axle member 20. The axle member 20 maintains alignment of the rollers 19.

Each of the rollers 19 comprises a plurality of ridges 22. The ridges 22 are positioned around a periphery of the associated one of the rollers 19. The ridges 22 facilitate the associated one of the rollers 19 engaging the associated one of the handkerchiefs and enhancing friction between the associated one of the rollers 19 and finger of the user for dispensing the associated one of the handkerchiefs.

The lid member 17 comprises a plurality of roller slots 23. Each of the roller slots 23 extends through the lid member 17. Each of the roller slots 23 is aligned with one of the rollers 19 of the dispensing assembly 18. Each of the roller slots 23 permits the associated one of the rollers 19 to extend through the lid member 17 to be accessed by the user when the user wishes to dispense one of the handkerchiefs.

A calculator assembly 24 is coupled to the lid member 17. The calculator assembly 24 is designed for being actuated by the user to perform math functions.

The calculator assembly 24 comprises a calculator processing assembly 25. The calculator processing assembly 25 is coupled to a bottom surface of the lid member 17 whereby the calculator processing assembly 25 is hidden from view when the lid member 17 is positioned over the housing 11. The calculator processing assembly 25 is designed for performing math functions when the calculator assembly 24 is actuated by the user.

The calculator assembly 24 comprises a plurality of keys 26. Each of the keys 26 extends through the lid member 17. Each of the keys 26 is operationally coupled to the calculator processing assembly 25. Each of the keys 26 is designed for being actuated by the user for entering numbers and functions into the calculator processing assembly 25 for the calculator processing assembly 25 to perform the math function.

The calculator assembly 24 comprises a display member 27. The display member 27 is coupled to the lid member 17 whereby the display member 27 is designed for being viewed by the user when the lid member 17 is positioned over the housing 11. The display member 27 is operationally coupled to the calculator processing assembly 25 whereby the display member 27 is for displaying the numbers entered into the calculator processing assembly 25 and the result of the math function calculated by the calculator processing assembly 25.

In uses the user places a plurality of handkerchiefs into the receiving space 14 of the housing 11 so that each of the handkerchiefs is positioned under one of the rollers 19 and a portion is extending through the dispensing slot 16 of the housing 11. The lid member 17 is the pivoted and positioned over the housing 11 to close the receiving space 14. When the user wishes the user rolls one of the rollers 19 with a finger or thumb and the rides engage the handkerchief to dispense the associated one of the handkerchiefs through the dispensing slot 16. The user may use the keys 26 to enter a desired math calculation into the calculation processing assembly and observe the results of the math calculation in the display member 27.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handkerchief dispensing apparatus for dispensing handkerchiefs to a user, the handkerchief dispensing apparatus comprising:

a housing comprising a base wall and a perimeter wall, said perimeter wall and said base wall defining a receiving space of said housing, said receiving space of said housing comprising an open end such that said open end permits the handkerchiefs to be inserted into said receiving space of said housing, said base wall comprising a dispensing slot extending through said base wall of said housing, said dispensing slot being adapted for permitting a portion of each of the handkerchiefs to extend through said base wall when the handkerchiefs are positioned in said receiving space of said housing;

a lid member being hingably coupled to said housing, said lid member selectively closing said open end of said receiving space when said lid member is positioned over said housing;

a dispensing assembly being coupled to said housing, said dispensing assembly being adapted for engaging the handkerchiefs such that said dispensing assembly feeds one of the handkerchiefs through said dispensing slot when said dispensing assembly is actuated by the user; and a calculator assembly being coupled to said lid member, said electronic calculator assemble being adapted for being actuated by the user to perform math functions.

2. The handkerchief dispensing apparatus as set forth in claim 1, further comprising:

said dispensing assembly comprising a plurality of rollers, each of said rollers being rotatably coupled to said housing, each of said rollers being adapted for engaging one of the handkerchiefs such that each of said rollers is adapted to facilitate dispensing of an associated one of the handkerchiefs when one of said rollers is rotated with respect to said housing by the user.

3. The handkerchief dispensing apparatus as set forth in claim 2, further comprising:

said dispensing assembly comprising an axle member, said axle member extending between a pair of side walls of said perimeter wall, each of said rollers being rotatably coupled to said axle member such that each of said rollers rotates around said axle member, said axle member maintaining alignment of said rollers.

4. The handkerchief dispensing apparatus as set forth in claim 2, further comprising:

each of said rollers comprising a plurality of ridges, said ridges being positioned around a periphery of the associated one of said rollers, said ridges facilitate the associated one of said rollers engaging the associated one of the handkerchiefs and enhancing friction between the associated one of said rollers and finger of the user for dispensing the associated one of the handkerchiefs.

5. The handkerchief dispensing apparatus as set forth in claim 2, further comprising:

said lid member comprising a plurality of roller slots, each of said roller slots extending through the lid member, each of said roller slots being aligned with one of said rollers of said dispensing assembly, each of said roller slots permitting the associated one of said rollers to extend through said lid member to be accessed by the user when the user wishes to dispense one of the handkerchiefs.

6. The handkerchief dispensing apparatus as set forth in claim 1, further comprising:

said calculator assembly comprising a calculator processing assembly, said calculator processing assembly being coupled to a bottom surface of said lid member such that said calculator processing assembly is hidden from view when said lid member is positioned over said housing, said calculator processing assembly being adapted for performing math functions when said calculator assembly is actuated by the user.

7. The handkerchief dispensing apparatus as set forth in claim 6, further comprising:

said calculator assembly comprising a plurality of keys, each of said keys extending through said lid member, each of said keys being operationally coupled to said calculator processing assembly, each of said keys being adapted for being actuated by the user for entering numbers and functions into said calculator processing assembly for said calculator processing assembly to perform the math function.

8. The handkerchief dispensing apparatus as set forth in claim 7, further comprising:

said calculator assembly comprising a display member, said display member being coupled to said lid member such that said display member is adapted for being viewed by the user when said lid member is positioned over said housing, said display member being operationally coupled to said calculator processing assembly such that said display member is for displaying the numbers entered into said calculator processing assembly and the result of the math function calculated by said calculator processing assembly.

9. The handkerchief dispensing apparatus as set forth in claim 1, further comprising:

said dispensing assembly comprising a plurality of rollers, each of said rollers being rotatably coupled to said housing, each of said rollers engaging one of the handkerchiefs such that each of said rollers is adapted to facilitate dispensing of the associated one of the handkerchiefs when one of said rollers is rotated with respect to said housing by the user;

said dispensing assembly comprising an axle member, said axle member extending between a pair of side walls of said perimeter wall, each of said rollers being rotatably coupled to said axle member such that each of said rollers rotates around said axle member, said axle member maintaining alignment of said rollers;

each of said rollers comprising a plurality of ridges, said ridges being positioned around a periphery of the associated one of said rollers, said ridges facilitate the associated one of said rollers engaging the associated one of the handkerchiefs and enhancing friction between the associated one of said rollers and finger of the user for dispensing the associated one of the handkerchiefs;

said lid member comprising a plurality of roller slots, each of said roller slots extending through the lid member, each of said roller slots being aligned with one of said rollers of said dispensing assembly, each of said roller slots permitting the associated one of said rollers to extend through said lid member to be accessed by the user when the user wishes to dispense one of the handkerchiefs;

said calculator assembly comprising a calculator processing assembly, said calculator processing assembly being coupled to a bottom surface of said lid member such that said calculator processing assembly is hidden from view when said lid member is positioned over said housing, said calculator processing assembly being adapted for performing math functions when said calculator assembly is actuated by the user;

said calculator assembly comprising a plurality of keys, each of said keys extending through said lid member, each of said keys being operationally coupled to said calculator processing assembly, each of said keys being adapted for being actuated by the user for entering numbers and functions into said calculator processing assembly for said calculator processing assembly to perform the math function; and said calculator assembly comprising a display member, said display member being coupled to said lid member such that said display member is adapted for being viewed by the user when said lid member is positioned over said housing, said display member being operationally coupled to said calculator processing assembly such that said display member is for displaying the numbers entered into said calculator processing assembly and the result of the math function calculated by said calculator processing assembly.

10. A handkerchief dispensing apparatus for dispensing handkerchiefs to a user, the handkerchief dispensing apparatus comprising:

a housing comprising a base wall and a perimeter wall, said perimeter wall and said base wall defining a receiving space of said housing, said receiving space of said housing comprising an open end such that said open end permits the handkerchiefs to be inserted into said receiving space of said housing, said base wall comprising a dispensing slot extending through said base wall of said housing, said dispensing slot being adapted for permitting a portion of each of the handkerchiefs to extend through said base wall when the handkerchiefs are positioned in said receiving space of said housing;

a lid member being hingably coupled to said housing, said lid member selectively closing said open end of said receiving space when said lid member is positioned over said housing;

a dispensing assembly being coupled to said housing, said dispensing assembly being adapted for engaging the handkerchiefs such that said dispensing assembly feeds one of the handkerchiefs through said dispensing slot when said dispensing assembly is actuated by the user;

said dispensing assembly comprising a plurality of rollers, each of said rollers being rotatably coupled to said housing, each of said rollers engaging one of the handkerchiefs such that each of said rollers is associated with one of the handkerchiefs when one of said rollers is rotated with respect to said housing by the user; and each of said rollers comprising a plurality of ridges, said ridges being positioned around a periphery of the associated one of said rollers, said ridges facilitate the associated one of said rollers engaging the associated one of the handkerchiefs and enhancing friction between the associated one of said rollers and finger of the user for dispensing the associated one of the handkerchiefs.

11. The handkerchief dispensing apparatus as set forth in claim 10, further comprising:

said dispensing assembly comprising an axle member, said axle member extending between a pair of side walls of said perimeter wall, each of said rollers being rotatably coupled to said axle member such that each of said rollers rotates around said axle member, said axle member maintaining alignment of said rollers.

12. The handkerchief dispensing apparatus as set forth in claim 10, further comprising:

said lid member comprising a plurality of roller slots, each of said roller slots extending through the lid member, each of said roller slots being aligned with one of said rollers of said dispensing assembly, each of said roller slots permitting the associated one of said rollers to extend through said lid member to be accessed by the user when the user wishes to dispense one of the handkerchiefs.

13. A handkerchief dispensing apparatus for dispensing handkerchiefs to a user, the handkerchief dispensing apparatus comprising:

a housing comprising a base wall and a perimeter wall, said perimeter wall and said base wall defining a receiving space of said housing, said receiving space of said housing comprising an open end such that said open end is permits the handkerchiefs to be inserted into said receiving space of said housing, said base wall comprising a dispensing slot extending through said base wall of said housing, said dispensing slot being adapted for permitting a portion of each of the handkerchiefs to extend through said base wall when the handkerchiefs are positioned in said receiving space of said housing;

a lid member being hingably coupled to said housing, said lid member selectively closing said open end of said receiving space when said lid member is positioned over said housing;

a dispensing assembly being coupled to said housing, said dispensing assembly being adapted for engaging the handkerchiefs such that said dispensing assembly feeds one of the handkerchiefs through said dispensing slot when said dispensing assembly is actuated by the user;

said dispensing assembly comprising a plurality of rollers, each of said rollers being rotatably coupled to said housing, each of said rollers engaging one of the handkerchiefs such that each of said rollers is to facilitate dispensing of an associated one of the handkerchiefs when one of said rollers is rotated with respect to said housing by the user; and said lid member comprising a plurality of roller slots, each of said roller slots extending through the lid member, each of said roller slots being aligned with one of said rollers of said dispensing assembly, each of said roller slots permitting the associated one of said rollers to extend through said lid member to be accessed by the user when the user wishes to dispense one of the handkerchiefs.

14. The handkerchief dispensing apparatus as set forth in claim 13, further comprising:

said dispensing assembly comprising an axle member, said axle member extending between a pair of side walls of said perimeter wall, each of said rollers being rotatably coupled to said axle member such that each of said rollers rotates around said axle member, said axle member maintaining alignment of said rollers.

* * * * *